US005685583A

United States Patent [19]

Meck et al.

[11] Patent Number: 5,685,583

[45] Date of Patent: Nov. 11, 1997

[54] DOOR KNOB CONSTRUCTION

[75] Inventors: Leslie A. Meck, Fleetwood; Philip C. Ellis, Reading, both of Pa.

[73] Assignee: Baldwin Hardware Corporation, Reading, Pa.

[21] Appl. No.: 672,836

[22] Filed: Jun. 28, 1996

[51] Int. Cl.[6] ..... E05B 1/00

[52] U.S. Cl. ..... 292/347; 70/224; 70/DIG. 31

[58] Field of Search ..... 292/347, 357, 292/353, 348; 70/224, DIG. 31, 215, 216

[56] References Cited

U.S. PATENT DOCUMENTS

| | | | |
|---|---|---|---|
| 450,115 | 4/1891 | Taylor | 292/347 |
| 949,967 | 2/1910 | Arens | 70/224 |
| 1,919,455 | 7/1933 | Wilson | 292/347 X |
| 1,992,126 | 2/1935 | Hurd | 70/224 |
| 1,996,357 | 4/1935 | Voight | 292/347 |
| 2,062,765 | 12/1936 | Schlage | 70/224 |
| 2,082,351 | 6/1937 | Moore | 70/224 |
| 3,077,100 | 2/1963 | Gerlach | 292/347 X |
| 3,125,877 | 3/1964 | Fryer | 70/224 |
| 3,190,684 | 6/1965 | Russell | 292/347 |
| 3,427,061 | 2/1969 | McMeen et al. | 292/353 |

*Primary Examiner*—Rodney M. Lindsey

*Attorney, Agent, or Firm*—Edgar A. Zarins; Malcolm L. Sutherland

[57] ABSTRACT

A door knob construction featuring a machined knob and cover to incorporate decorative detail. The knob construction consists of a knob body, a shank threadably connected to the knob body and a cover which fits over the shank to complete the decorative knob assembly. The knob body is hollow to accommodate the lock cylinder and includes a small diameter hole through which the cylinder protrudes. The back of the knob body includes threads to accept the knob shank. Upon assembly, a bore is drilled across the threads and a pin is inserted to prevent disassembly of the knob body from the shank. The shank includes longitudinal ridges to form an interference fit with the decorative shank cover.

16 Claims, 1 Drawing Sheet

DOOR KNOB CONSTRUCTION

BACKGROUND OF THE INVENTION

I. Field of the Invention

This invention relates to a door knob construction and, in particular, an outside door knob having a solid machined body wherein decorative detail can be applied to the knob and hollowed out to receive the lock cylinder.

II. Description of the Prior Art

Door knobs for use with ANSI series 4000 bored-through locks are commonly made from sheet metal stampings. Such knobs are well suited for this class of locks which consist of a two part central housing containing the lock mechanism that connects the knobs to the latch, each half of the housing supporting a tubular spindle which rotates in the housing. Tubular shanks are closely sized to fit on the spindles and the stamped knobs are slidably installed onto the spindles. The inside knob may be permanently attached to the housing/spindle assembly but the outside knob is usually removable to allow rekeying of the lock cylinder. Various well known constructions are employed to allow the cylinder to be installed in or removed from the trim.

Stamped knobs are satisfactory for general use but the decorative detail that can be applied by stamping is very limited. Solid knobs with machined fasteners can be easily applied to the inside trim since it is not necessary to make this inside knob resistant to removal. Additionally, because there is no cylinder on the inside the knob can be bored straight through and attached to the shank with a set screw. The outside knob should be removable only with the key and contains a lock cylinder with features larger than the diameter of the shank. Rekeying requires that an opening larger than the knob shank be available when the knob is removed but covered when the knob is installed. A solid knob may be machined to the requirements of the lock set as well as incorporate decorative detail not found in stamped door knobs.

SUMMARY OF THE PRESENT INVENTION

The present invention overcomes the disadvantages of the prior known and outside door knob machined from solid stock to receive the lock cylinder while incorporating decorative detail.

The knob construction of the present invention embodies three primary components including a knob body, a shank and a shank cover. In a preferred embodiment, the knob body and shank cover are machined from brass on a screw machine and the shank is a zinc die casting. The knob body is hollowed out to accommodate a lock cylinder and includes a small diameter aperture in the front face which allows the cylinder plug to protrude through the knob. The opening in the back of the knob body is large enough to accommodate the cylinder. The rear opening is threaded and counterbored to receive the shank and shank cover, respectively. The shank of the knob construction has an enlarged outer end with threads to threadably engage the knob body. The knob shank is slotted along one side to allow insertion of the lock cylinder after the knob body and shank have been assembled. The neck of the shank includes a plurality of raised ribs creating an outside diameter slightly larger than the inner diameter of the shank cover. When the shank cover is placed over the shank, the ribs create a tight interference fit between the shank and the cover. Additionally, the neck of the shank includes a notch adapted to engage a lug on the lock spindle allowing the spindle to rotate upon rotation of the door knob. The larger outer end of the shank cover engages the counterbore in the knob body and conceal the lock cylinder, shank and knob/shank joint. After assembling the knob body to the shank, a pin is inserted longitudinally across the threads to prevent disassembly.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
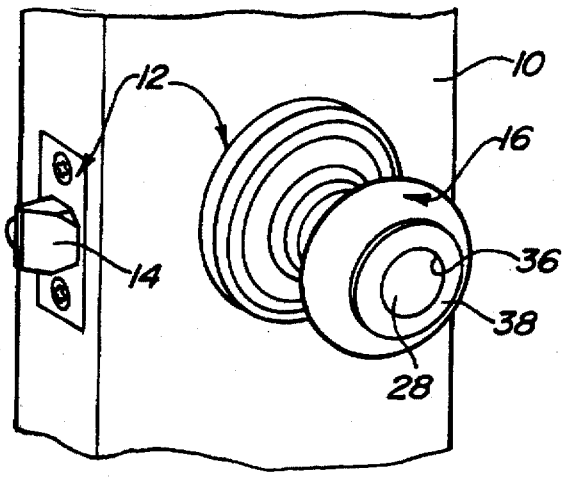
FIG. 1 is a perspective view of a door knob construction embodying the present invention mounted on a door.

Referring first to FIG. 1, there is shown a partial section of a door 10 for preventing entry through a passageway and including a door lock assembly 12 for selectively latching and locking the door 10 in a closed position. As is well known, operation of the door lock assembly 12 provides selective passage through the door 10 passageway. The lock assembly 12 generally includes a bolt 14 which engages a corresponding aperture in the door jamb to latch the door 10 in a closed position. The bolt 14 is operable through an internal locking mechanism (not shown) which, in turn, is operably connected to door knobs such that rotation of the door knobs causes the bolt 14 to retract into the door 10. The lock assembly 12 may be selectively locked against operation fixing the bolt 14 in the extended position. In a lock assembly 12, as opposed to a simple entry set, an inner door knob (not shown) is provided which allows manual locking and opening from the interior of the room and an outer door knob 16 which requires a key to disengage the locking mechanism.

Figure 2:
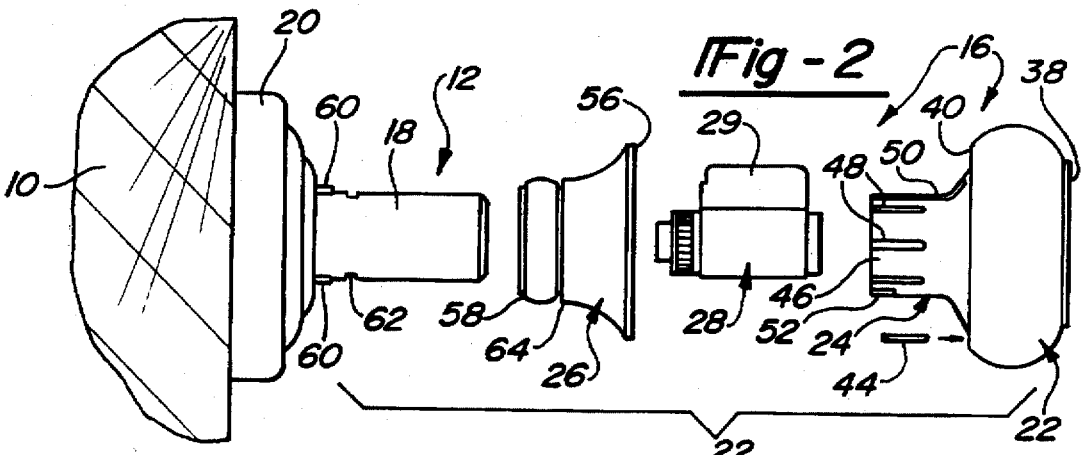
FIG. 2 is an exploded view of the door knob construction.
Figure 3:
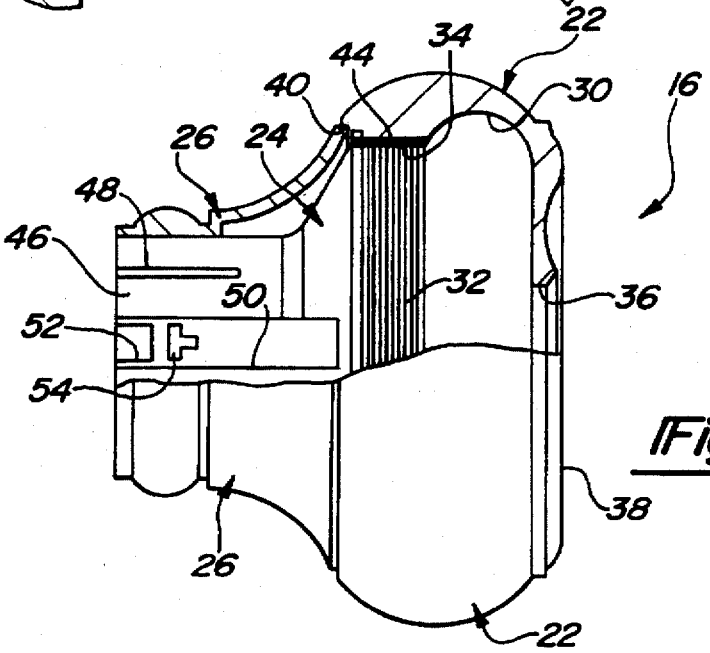
FIG. 3 is a partial cross-sectional view of the door knob construction.

Referring now to FIGS. 1 through 3, a spindle 18 of the lock assembly 12 extends from the interior of the door 10. A rosette 20 encloses the locking mechanism within the door 10. The door knob construction 16 of the present invention is operably connected to the spindle 18 of the lock 12 to control the lock 12.

The door knob construction 16 embodying the present invention includes a knob body 22 machined to the desired configuration and decorative detail from solid stock, a shank 24 attached to the knob body 22, and a shank cover 26 matingly received over the shank 24. A lock cylinder 28 is housed within the knob body 22 and shank 24 as will be subsequently described and operably connected to the lock mechanism 12 to allow selective entry using a key. The knob body 22 is machined with an inner cavity 30 and threads 32 at a larger rear opening 34 in the knob body 22. A central aperture 36 formed in the face 38 of the knob body 22 allows the lock cylinder 28 to protrude through the face 38 of the knob body. A counterbore or rabbet 40 is formed on the rear of the knob body 22 proximate the threads 32.

The shank 24 is preferably a zinc die casting threadably connected to the knob body 22 to enclose the lock cylinder 28. The shank 24 is substantially funnel-shaped with a circular forward end having threads 32 adapted to threadably engage the opening 34 of the knob body 22. Upon assembly, the shank 24 is threaded into the knob body 22. Once threadably assembled, a small bore is drilled longitudinally across the threads 32,34 and a pin 44 inserted to prevent disassembly by locking the components together. The neck 46 of the shank 24 includes a plurality of raised ribs 48 extending longitudinally along the neck 46. A first longitudinal slot 50 is formed along one side of the neck 46 and a second slot 52 is formed in the opposite side of the neck 46. A T-slot 54 is formed in the neck 46 proximate the shorter second slot 52. Each of these slots are formed in the shank 24 to accommodate the lock cylinder 28 and the spindle 18 which are received within the knob construction 16 as will be subsequently described.

In order to conceal the shank 24 and thwart removal of the knob 16, a shank cover 26 is mounted to the shank 24. The shank cover 26 is also funnel-shaped and may be machined with the desired decorative detail. The funnel-shaped shank cover 26 has an enlarged forward end 56 and a neck 58. The forward end 56 is adapted to be received within the counterbore 40 of the knob body 22. The neck 58 of the cover 26 matingly receives the shank 24. The raised ridges 48 create an interference fit with the neck 58 of the shank cover 26 to prevent rattling of the cover 26 on the knob construction 16. Upon assembly, the shank cover 26 is captured between the rosette 20 and the knob body 22 thereby concealing the shank 24, lock cylinder 28 and spindle 18 creating a decorative, finished appearance to the lock assembly.

Assembly of the knob construction 16 provides a solid machined knob with decorative detail and yet is resistant to tampering and disassembly. With the lock mechanism mounted within the door 10, the knob construction 16 can be mounted to the spindle 18 extending outwardly from the door 10. The shank 24 is threadably mounted to the machined knob body 22 by inserting the threaded end 32 of the shank 24 into the threaded opening 34 of the knob body 22. Once threadably secured, a bore is drilled across the threads 32, 42 and pin 44 inserted to lock the shank 24 to the knob body 22. The lock cylinder 28 is inserted through the shank 24 such that the flange 29 on the cylinder 28 is received within slot 50 of the shank 24 and the cylinder 28 protrudes through the face aperture 36. The inner end of the lock cylinder 28 operably engages the internal latching mechanism upon insertion through the spindle 18. The shank cover 26 is positioned over the shank 24 and the entire knob construction 16 is mounted to the spindle 18. The spindle 18 is provided with opposing lugs 60 adapted to engage the slots 50 and 52 such that rotation of the knob body 22 transmits to the spindle 18. Alternatively, the lugs 60 and therefore the corresponding slot 50 and notch 52 may be positioned and/or configured to ensure assembly of the knob construction in only one orientation. Additionally, a spring-biased detent 62 is also formed in the spindle 18 proximate one of the lugs 60 and biasingly received within the T-slot 54. The detent 62 positioned in the T-slot 54 prevents withdrawal of the knob construction 16 from the spindle 18. An aperture 64 in the side of the shank cover 26 allows depression of the detent 62 facilitating removal of the knob 16 for rekeying of the lock.

Thus, the knob construction of the present invention provides a solid knob machined to the desired configuration and decorative detail which may be used as an outside knob. The knob houses the lock cylinder which may be rekeyed as necessary by detaching the knob assembly from the lock spindle.

The foregoing detailed description has been given for clearness of understanding only and no unnecessary limitations should be understood therefrom as some modifications will be obvious to those skilled in the art without departing from the scope and spirit of the appended claims.

What is claimed is:

1. A door knob construction for operable connection to a spindle of a lock mechanism mounted within a door, said door knob construction comprising:

a knob body having a threaded opening to an interior chamber of said knob body;

a shank threadably attached to said knob body, said shank including a head portion having threads for engaging said knob body and a neck portion having a longitudinal slot formed along least a portion of said neck portion to facilitate insertion of a lock cylinder within said knob body and shank; and a shank cover engaging said knob body and matingly mounted on said shank to conceal said shank.

2. The knob construction as defined in claim 1 and further comprising means for preventing separation of said knob body and shank.

3. The knob construction as defined in claim 2 wherein said means for preventing separation of said knob body and shank includes a pin disposed within the threads between said shank and knob body preventing unthreading of said knob body from said shank.

4. The knob construction as defined in claim 1 wherein said shank neck portion includes means for creating an interference fit between said shank and said shank cover.

5. The knob construction as defined in claim 4 wherein said interference means includes a plurality of raised ridges formed on said shank neck, said raised ridges frictionally engaging said shank cover.

6. The knob construction as defined in claim 1 wherein said shank includes a notch formed in a side wall of said shank diametrically opposite from said longitudinal slot, said slot and notch for engaging corresponding lugs on the spindle to operably connect said knob construction to the lock mechanism.

7. The knob construction as defined in claim 6 wherein said notch and said slot have different widths such that said shank is engagable with the corresponding lugs on the lock spindle in only one orientation.

8. The knob construction as defined in claim 2 wherein said knob body includes a counterbore coaxial with said threaded opening of said knob body, said shank cover including an outer end matingly received within said counterbore of said knob body to completely conceal said shank.

9. The knob construction as defined in claim 8 wherein said shank cover incudes an aperture formed through a wall thereof, said aperture facilitating selective engagement of a spring-biased detent on the spindle for detachment of said knob construction from the spindle.

10. A door knob construction for operable connection to a spindle of a lock mechanism mounted within a door, said door knob construction comprising:

a knob body machined with decorative detail, an interior chamber and a threaded opening to said chamber;

a shank threadably attached to said knob body, said shank having a substantially funnel-shaped configuration with a threaded head portion threadably engaging said knob body and a neck portion, said neck portion including at least one longitudinal ridge and a longitudinal slot formed along at least a portion of said neck portion to facilitate insertion of a lock cylinder within said knob body and shank;

means for preventing threaded detachment of said knob body from said shank; and a shank cover engaging said knob body and matingly mounted on said shank to conceal said shank, said at least one longitudinal ridge forming an interference fit between said shank and shank cover.

11. The door knob construction as defined in claim 10 wherein said means for preventing threaded detachment of said knob body from said shank includes a pin disposed within the threads between said shank and knob body preventing rotation of said knob body relative to said shank.

12. The door knob construction as defined in claim 10 wherein said neck portion of said shank includes a notch, said notch for engaging corresponding lugs on the spindle to operably connect said knob construction to the lock mechanism.

13. The door knob construction as defined in claim 12 wherein said notch and slot have different widths such that said shank is engageable with the corresponding lugs on the spindle in only one orientation.

14. The door knob construction as defined in claim 12 wherein said notch and slot are relatively positioned on said shank corresponding to the position of the lugs on the spindle facilitating engagement between said shank and the spindle in only one orientation.

15. The door knob construction as defined in claim 10 wherein said knob body includes a counterbore coaxial with said threaded opening of said knob body, said shank cover including an outer end matingly received within said counterbore of said knob body to completely conceal said shank.

16. The door knob construction as defined in claim 15 wherein said shank cover includes an aperture formed through a wall thereof, said aperture facilitating selective engagement of a spring biased detent on the lock spindle for detachment of said knob construction from the spindle.

* * * * *